US007784133B2

(12) United States Patent
Bang et al.

(10) Patent No.: US 7,784,133 B2
(45) Date of Patent: Aug. 31, 2010

(54) WASHING MACHINE AND WATER LEVEL CONTROL METHOD THEREOF

(75) Inventors: Eun Suk Bang, Seoul (KR); Sang Yeon Pyo, Suwon-si (KR); Jae Ryong Park, Hwaseong-si (KR); Sung Hoon Kim, Suwon-si (KR); Jee Hun Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 582 days.

(21) Appl. No.: 11/790,455

(22) Filed: Apr. 25, 2007

(65) Prior Publication Data

US 2008/0034809 A1 Feb. 14, 2008

(30) Foreign Application Priority Data

Aug. 14, 2006 (KR) ..... 10-2006-0076821

(51) Int. Cl.
*D06F 33/02* (2006.01)

(52) U.S. Cl. ..... 8/158; 68/12.05; 68/12.19; 68/144

(58) Field of Classification Search ..... 68/144, 68/145, 146; 8/158
See application file for complete search history.

(56) References Cited

U.S. PATENT DOCUMENTS

| | | | | |
|---|---|---|---|---|
| 2,768,518 | A * | 10/1956 | Douglas | 68/12.23 |
| 3,022,654 | A * | 2/1962 | Aberle | 68/18 F |
| 4,941,333 | A * | 7/1990 | Blessing | 68/19.2 |
| 2003/0051514 | A1 | 3/2003 | Kim et al. | |
| 2004/0154644 | A1 | 8/2004 | Kim | |
| 2004/0154645 | A1 | 8/2004 | Kim | |

FOREIGN PATENT DOCUMENTS

| | | |
|---|---|---|
| CN | 1616746 A | 5/2005 |
| DE | 199 02 911 | 9/1999 |
| EP | 0 726 349 | 8/1996 |
| EP | 1 500 736 | 1/2005 |
| EP | 1 500 736 A2 | 1/2005 |
| JP | 8-215472 | 8/1996 |
| KR | 96-37514 | 12/1996 |
| KR | 2005-11515 | 1/2005 |
| WO | WO 2006/071022 | 7/2006 |

OTHER PUBLICATIONS

Extended European Search Report, mailed Dec. 11, 2007 and issued in corresponding European Patent Application No. 07107315.9-2314.

Chinese Office Action issued Aug. 21, 2009 in corresponding Chinese Patent Application 200710104955.1.

* cited by examiner

*Primary Examiner*—Frankie L Stinson
(74) *Attorney, Agent, or Firm*—Staas & Halsey LLP

(57) ABSTRACT

A washing machine and a water level control method thereof that can supply an appropriate amount of water based on the amount of laundry using a conventional water level sensor even when the washing machine has a holeless rotary drum. The water level control method includes supplying water between the water tub and the rotary drum, introducing the supplied water into the rotary drum, discharging the introduced water out of the rotary drum, and detecting the water level of the water remaining in the water tub, and comparing the detected water level with a predetermined water level and, when the detected water level is below the predetermined water level, resupplying water between the water tub and the rotary drum until the detected water level reaches the predetermined water level.

12 Claims, 5 Drawing Sheets

WASHING MACHINE AND WATER LEVEL CONTROL METHOD THEREOF

CROSS-REFERENCE TO RELATED APPLICATIONS

This application claims the benefit of Korean Patent Application No. 2006-76821, filed on Aug. 14, 2006 in the Korean Intellectual Property Office, the disclosure of which is incorporated herein by reference.

BACKGROUND OF THE INVENTION

1. Field of the Invention

The present invention relates to a washing machine and a water level control method thereof, and, more particularly, to a washing machine and a water level control method thereof that can supply an appropriate amount of water based on the amount of laundry.

2. Description of the Related Art

Generally, a washing machine (normally, a drum-type washing machine) is a machine in which, when a cylindrical rotary drum is rotated, laundry and wash water in the rotary drum are raised along the inner surface of the rotary drum and fall, whereby washing of the laundry is accomplished. The washing machine includes a water tub to receive water (wash water or rinse water) and a rotary drum rotatably mounted in the water tub. The rotary drum has a plurality of holes (through-holes) formed at the entire circumference thereof such that, when water is supplied into the water tub for washing, the water filling the water tub flows to the laundry in the rotary drum through the holes of the rotary drum.

In the conventional washing machine with the rotary drum having the holes, however, when water (wash water or rinse water) is supplied into the water tub, it is necessary to supply water to the extent that a space between the inner surface of the water tub and the outer surface of the rotary drum and laundry in the rotary drum are submerged in the water. As a result, the consumption of water is excessive.

In order to solve this problem, there has been developed a washing machine with a rotary drum having no holes formed at the circumference thereof (a holeless washing machine), an example of which is disclosed in Korean Unexamined Patent Publication No. 2005-11515.

According to the disclosure, no holes are formed at the circumference of the rotary drum, and an additional water circulation unit is provided to supply water into the rotary drum. After water (wash water or rinse water) is supplied into the water tub, the water received in the water tub is introduced into the rotary drum through the circulation unit, whereby the consumption of water is reduced.

In the washing machine with the holeless rotary drum, the water is introduced into the rotary drum through the circulation of the water. Since no holes are formed at the circumference of the rotary drum, however, the remaining water, which has not been absorbed into the laundry, is not discharged out of the rotary drum. As a result, it is not possible to confirm whether an appropriate amount of water has been supplied based on the amount of the laundry.

When water supplied into the water tub is absorbed into the laundry through the holes formed at the circumference of the rotary drum, and the water level is changed depending upon the amount of water absorbed by the laundry, a water level sensor is used to control additional supply of water based on the changed water level data, thereby supplying the optimum amount of water based on the amount of the laundry. However, the washing machine with the holeless rotary drum cannot adopt the water level sensor.

SUMMARY OF THE INVENTION

Therefore, it is an aspect of the invention to provide a washing machine and a water level control method thereof that can supply an appropriate amount of water based on the amount of laundry using a conventional water level sensor even when the washing machine has a holeless rotary drum.

It is another aspect of the invention to provide a washing machine and a water level control method thereof that can supply an appropriate amount of water based on the amount of laundry by setting a number of water resupplies according to the amount of the laundry.

In accordance with one aspect, the present invention provides a water level control method of a washing machine including a water tub and a rotary drum mounted in the water tub to receive laundry, the rotary drum having no holes formed at the side corresponding to the water tub such that the flow of water from the water tub into the rotary drum is prevented, the water level control method including: supplying water between the water tub and the rotary drum; introducing the supplied water into the rotary drum, discharging the introduced water out of the rotary drum, and detecting the water level of the water remaining in the water tub; comparing the detected water level with a predetermined water level and, when the detected water level is below the predetermined water level, resupplying water between the water tub and the rotary drum; and introducing the resupplied water into the rotary drum, discharging the introduced water out of the rotary drum, and controlling the water resupply operation until the water level of the water remaining in the water tub reaches the predetermined water level.

Supplying water between the water tub and the rotary drum may include supplying a basic amount of water between the water tub and the rotary drum up to a height at which the water supplied into the water tub can flow into the rotary drum.

The water level control method may further include: rotating the rotary drum to wet the laundry after supplying water between the water tub and the rotary drum.

Wetting the laundry may include operating the rotary drum at a predetermined first RPM and operation rate based on the amount of the laundry.

Detecting the water level of the water remaining in the water tub may include operating a circulation unit to introduce the water from the water tub into the rotary drum, and rotating the rotary drum such that the water introduced into the rotary drum is discharged out of the rotary drum into the water tub and measuring the water level of water gathered in the water tub.

During the discharge of the water, the rotary drum may be operated at a predetermined second RPM, and the second RPM is equal to or greater than the first RPM.

The water level control method may further include: setting a number of water resupplies according to the amount of the laundry, and resupplying water between the water tub and the rotary drum includes controlling a water resupply operation based on the set number of water resupplies.

The water level control method may further include: after the water is resupplied between the water tub and the rotary drum, detecting the water level of the changed water as the resupplied water is introduced into the rotary drum and then is discharged out of the rotary drum, the detecting the water level of the changed water being repeatedly performed for the set number of water resupplies.

When the water level of the water changed is above the predetermined water level, a subsequent washing operation set based on the amount of the laundry may be performed without repeating the set number of water resupplies.

In accordance with another aspect, the present invention provides a water level control method of a washing machine including a water tub and a rotary drum mounted in the water tub to receive laundry, the rotary drum having no holes formed at the side corresponding to the water tub such that the flow of water from the water tub into the rotary drum is prevented, the water level control method including: supplying water between the water tub and the rotary drum; introducing the supplied water into the rotary drum, discharging the introduced water out of the rotary drum, and detecting the water level of the water remaining in the water tub; and comparing the detected water level with a predetermined water level and, when the detected water level is above the predetermined water level, performing a subsequent washing operation set based on the amount of the laundry.

The predetermined water level may be the minimum amount of water supplied for heated washing.

In accordance with yet another aspect, the present invention provides a washing machine including: a water tub to receive water; a rotary drum mounted in the water tub to receive laundry; a circulation unit to introduce the water from the water tub into the rotary drum; and a control unit to control a water supply operation between the water tub and the rotary drum such that an appropriate amount of water can be supplied to the laundry.

Preferably, the rotary drum has no holes formed at the side corresponding to the water tub such that the flow of water from the water tub into the rotary drum is prevented.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
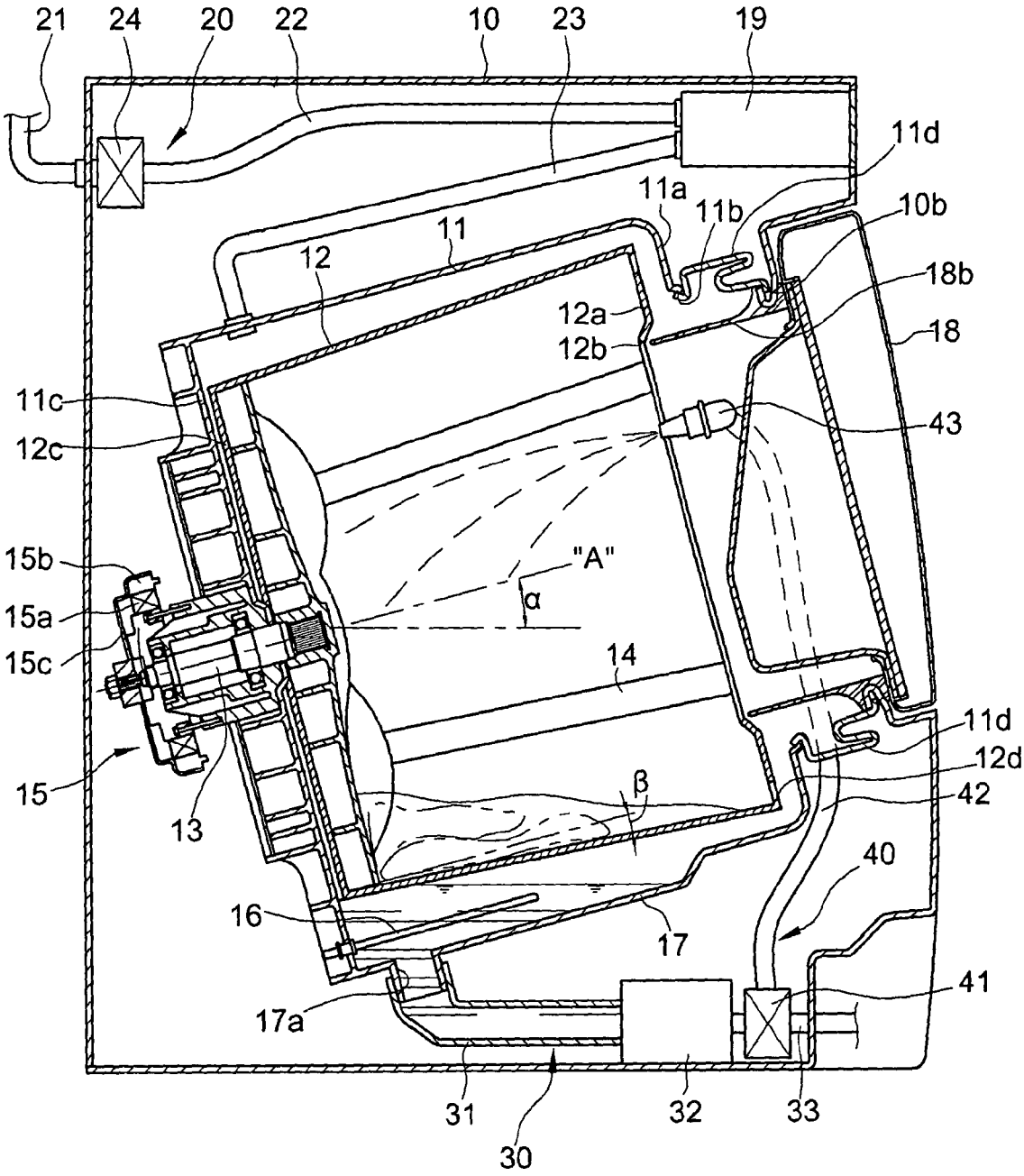
FIG. 1 is a sectional view illustrating a washing machine according to the present invention when the washing machine performs a washing operation.

Reference will now be made in detail to the embodiment of the present invention, examples of which are illustrated in the accompanying drawings, wherein like reference numerals refer to like elements throughout. The embodiment is described below to explain the present invention by referring to the figures.

Figure 2:
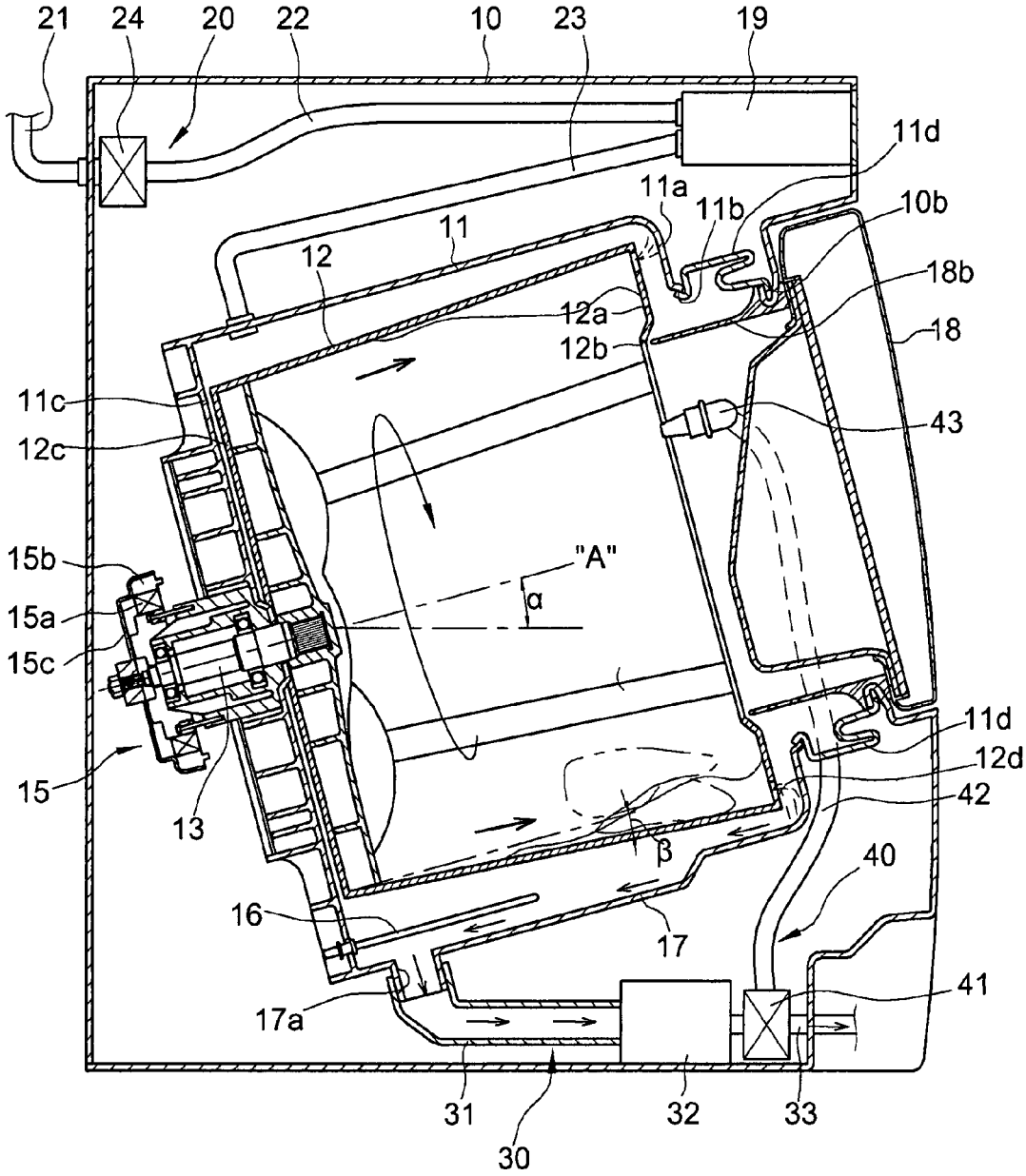
FIG. 2 is a sectional view illustrating the washing machine according to the present invention when the washing machine performs a water-discharging operation.

FIG. 1 is a sectional view illustrating a washing machine according to the present invention when the washing machine performs a washing operation, and FIG. 2 is a sectional view illustrating the washing machine according to the present invention when the washing machine performs a water-discharging operation.

Referring to FIGS. 1 and 2, a holeless washing machine according to the present invention includes a drum-type water tub 11 mounted in a machine body 10 to receive water (wash water or rinse water) and a rotary drum 12 rotatably mounted in the water tub 11.

The water tub 11 is mounted at a predetermined angle α to an installation surface of the washing machine such that a front part 11*a* of the water tub 11, in which an inlet 11*b* is formed, is higher than a rear part 11*c* of the water tub 11. The rotary drum 12, which is mounted in the water tub 11, is mounted in the same way as the water tub 11 such that a front part 12*a* of the rotary drum 12, in which an inlet 12*b* is formed, is higher than a rear part 12*c* of the rotary drum 12.

Specifically, a rotation axis A of the rotary drum 12 is at the predetermined angle α to the installation surface of the washing machine such that the front part 12*a* of the rotary drum 12, in which the inlet 12*b* is formed, is directed to the upper front. The rotary drum 12 has a rotary shaft 13 coupled to the center of the rear part 12*c* thereof. The rotary shaft 13 is rotatably supported at the rear center of the water tub 11. Consequently, the rotary drum 12 is rotatably mounted in the water tub 11.

The reason why the rotation axis A of the rotary drum 12 is at the predetermined angle α to the installation surface of the washing machine is to gather a predetermined amount of water for washing and rinsing in the rotary drum 12, when water is supplied into the rotary drum 12, such that laundry is wetted by the gathered water. At this time, the water is supplied into the rotary drum 12 up to the height of holes 12*d*. In order that an appropriate amount of water is gathered in the rotary drum 12 and washing is smoothly performed, the inclination angle α of the rotary drum 12 may be approximately 15 degrees.

In the front part 12*a* of the rotary drum 12 are also formed a plurality of holes 12*d*. At the inner surface of the rotary drum 12 are mounted a plurality of lifters 14 to lift and drop the laundry in the rotary drum 12 when the rotary drum 12 is rotated. The reason why the circumferential surface of the rotary drum 12 is at a predetermined angle β to the rotation axis A of the rotary drum 12 is to guide water flowing to the radial direction of the rotary drum 12 such that the water can flow to the holes 12*d* of the front part 12*a* along the inclined inner surface of the rotary drum 12 due to a centrifugal force, and then the water can be discharged out of the rotary drum 12, as shown in FIG. 2, when the rotary drum 12 is rotated at high speed during a water-discharging operation. In order to smoothly accomplish the water-discharging operation, the inclination angle β at the circumferential surface of the rotary drum 12 is preferably 0.5 degrees or more.

At the outside of the rear part 11*c* of the water tub 11 is mounted a motor 15 to rotate the rotary shaft 13 connected to the rotary drum 12 such that washing, rinsing, and spin-drying operations are performed. The motor 15 includes a stator 15*a* fixed to the rear part 11*c* of the water tub 11, a rotor 15*b* rotatably mounted at the outer circumference of the stator 15*a*, and a rotary disc 15*c* to connect the rotor 15*b* and the rotary shaft 13.

In the inner lower part of the water tub 11 is mounted a washing heater 16 to heat wash water supplied into the water tub 11. To this end, the water tub 11 is provided at the lower part there of with a heater receiving part 17, which protrudes downward such that the washing heater 16 is received in the heater receiving part 17, and, at the same time, a predetermined amount of wash water is gathered in the heater receiving part 17. Specifically, the heater receiving part 17 is constructed such that the washing heater 16 is submerged in the wash water gathered in the heater receiving part 17. Since the wash heater 16 is received in the heater receiving part 17, the rotary drum 12 can be rotated without interference with the washing heater 16.

In the front part of the machine body 10 is formed an inlet 18*b*, which corresponds to the inlet 12*b* of the rotary drum 12 and the inlet 11*b* of the water tub 11 such that laundry can be put into or removed from the rotary drum through the inlets. At the front part of the machine body 10 is mounted a door 18 to open and close the inlet 18*b*. Between the inlet 10*b* of the machine body 10 and the inlet 11*b* of the water tub 11 is mounted a cylindrical diaphragm 11*d* to prevent leakage of wash water.

Above the water tub is mounted a detergent supply unit 19 to supply detergent and a water supply unit 20 to supply water (wash water or rinse water).

The detergent supply unit 19 is partitioned into a plurality of sections. The detergent supply unit 19 is mounted in the front part of the machine body such that a user can easily put detergent and rinse into the respective sections. The partitioned sections include a preliminary wash detergent box to store detergent for preliminary washing, a main wash detergent box to store detergent for main washing, and a rinse box to store rinse for rinsing. This construction is disclosed in Korean Patent Application No. 2003-0011317. The partitioned sections may be constructed according to a generally known art.

The water supply unit 20 includes a first water supply pipe 22 connected between an external water supply pipe 21 to supply water (wash water or rinse water) into the water tub 11 and the detergent supply unit 19, a second water supply pipe 23 connected between the detergent supply unit 19 and the water tub 11, and a water supply valve 24 mounted on the first water supply pipe 22 to control the supply of water. This construction allows water to pass through the detergent supply unit 19 before the water is supplied into the water tub 11 such that the detergent stored in the detergent supply unit 19 can be supplied into the water tub 11.

The washing machine according to the present invention further includes a drainage unit 30 to drain water from the water tub 11 and a circulation unit 40 to supply the water heated by the washing heater 16 in the water tub 11 into the rotary drum 12. The drainage unit 30 includes a first drainage pipe 31 connected to a drainage port 17*a* formed at the heater receiving part 17 of the water tub 11 to guide the water in the water tub 11 to the outside, a drainage pump 32 mounted on the drainage pipe 31, and a drainage pipe 33 connected to the outlet side of the drainage pump 32. The circulation unit 40 includes a flow changing valve 41 mounted on the drainage pipe 33 connected to the outlet side of the drainage pump 32, a circulation pipe 42 extending from the flow changing valve 41 to the inlet 12*b* side of the rotary drum 12, and an injection nozzle 43 mounted at the outlet of the circulation pipe 42. The flow changing valve 41 serves to change of the flow of water such that the water from the outlet of the drainage pump 32 is drained to the outside or flows to the circulation pipe 42 side. The flow changing valve 41 may be a normal electric-powered three-way valve. The injection nozzle 43 is mounted adjacent to the inlet 12*b* of the rotary drum 12 to inject water into the rotary drum 12 through the inlet 12*b* of the rotary drum 12.

According to this construction, as shown in FIG. 1, the water received in the lower part of the water tub 11 can be injected into the rotary drum 12 through the drainage pipe 31 and the circulation pipe 42 when the drainage pump 32 is operated while the flow changing valve 41 is operated such that the water can flow to the circulation pipe 42. Also, as shown in FIG. 2, the water can be drained when the drainage pump 32 is operated while the flow changing valve 41 is operated such that the water can flow to the external drainage pipe 33.

Figure 3:
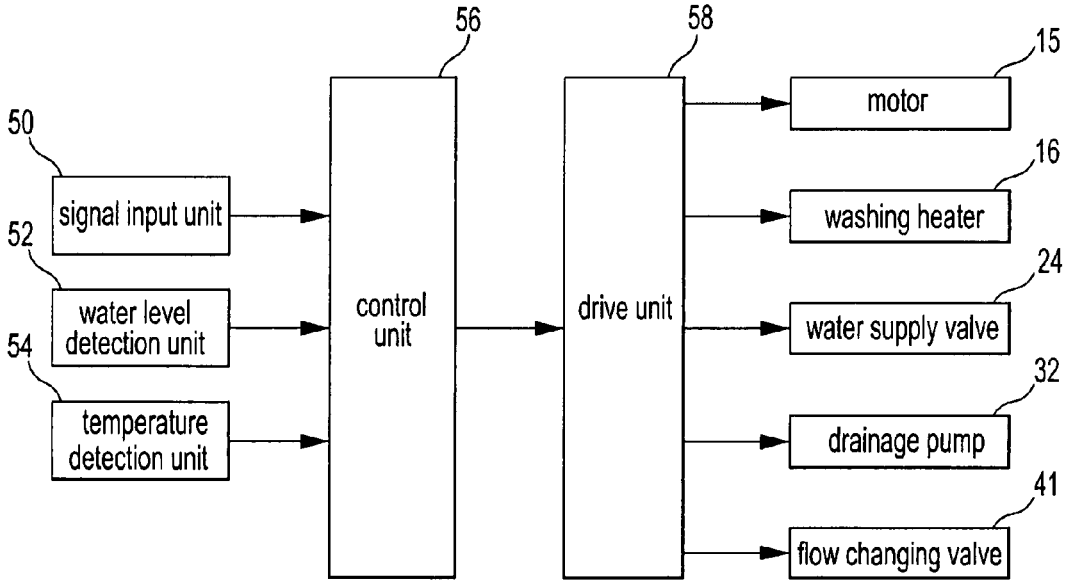
FIG. 3 is a block diagram illustrating the construction of a water level control device of the washing machine according to the present invention.

FIG. 3 is a block diagram illustrating the construction of a water level control device of the washing machine according to the present invention. In addition to the units shown in FIGS. 1 and 2, the washing machine further includes a signal input unit 50, a water level detection unit 52, a temperature detection unit 54, a control unit 56, and a drive unit 58.

The signal input unit 50 inputs operation information, such as a washing course, washing temperature, water-discharging RPM, and addition of rinsing, which is selected by a user, to the control unit 56. The water level detection unit 52 detects the water level of water supplied into the water tub 11, and the temperature detection unit 54 detects the temperature of water supplied into the water tub 11.

The control unit 56 is a microcomputer to control the washing machine based on the operation information inputted from the signal input unit 50. The control unit 56 stores motor RPM, motor operation rate (motor on-off time) and the number of water resupplies N (the number of times to resupply water to the minimum water level necessary for heating washing when water is absorbed into the laundry, and therefore, the water level is lowered) set according to the amount of load (the amount or weight of laundry) in the selected washing course.

Consequently, the control unit 56 controls the driving of the motor 15, the water supply unit 20, and the circulation unit 40 such that, when water (wash water or rinse water) is supplied, an appropriate amount of water can be supplied according to the amount of load.

The drive unit 58 drives the motor 15, the washing heater 16, the water supply valve 24, the drainage pump 32, and the flow changing valve 41 according to a driving control signal of the control unit 56.

Hereinafter, a water level control method of the washing machine with the above-stated construction will be described in detail.

The water level control method of the washing machine with the holeless rotary drum 12 according to the present invention is performed to supply an appropriate amount of water based on the amount of laundry by only changing an algorithm while using a water level sensor adopted in a conventional washing machine with a rotary drum having holes.

Figure 4A:
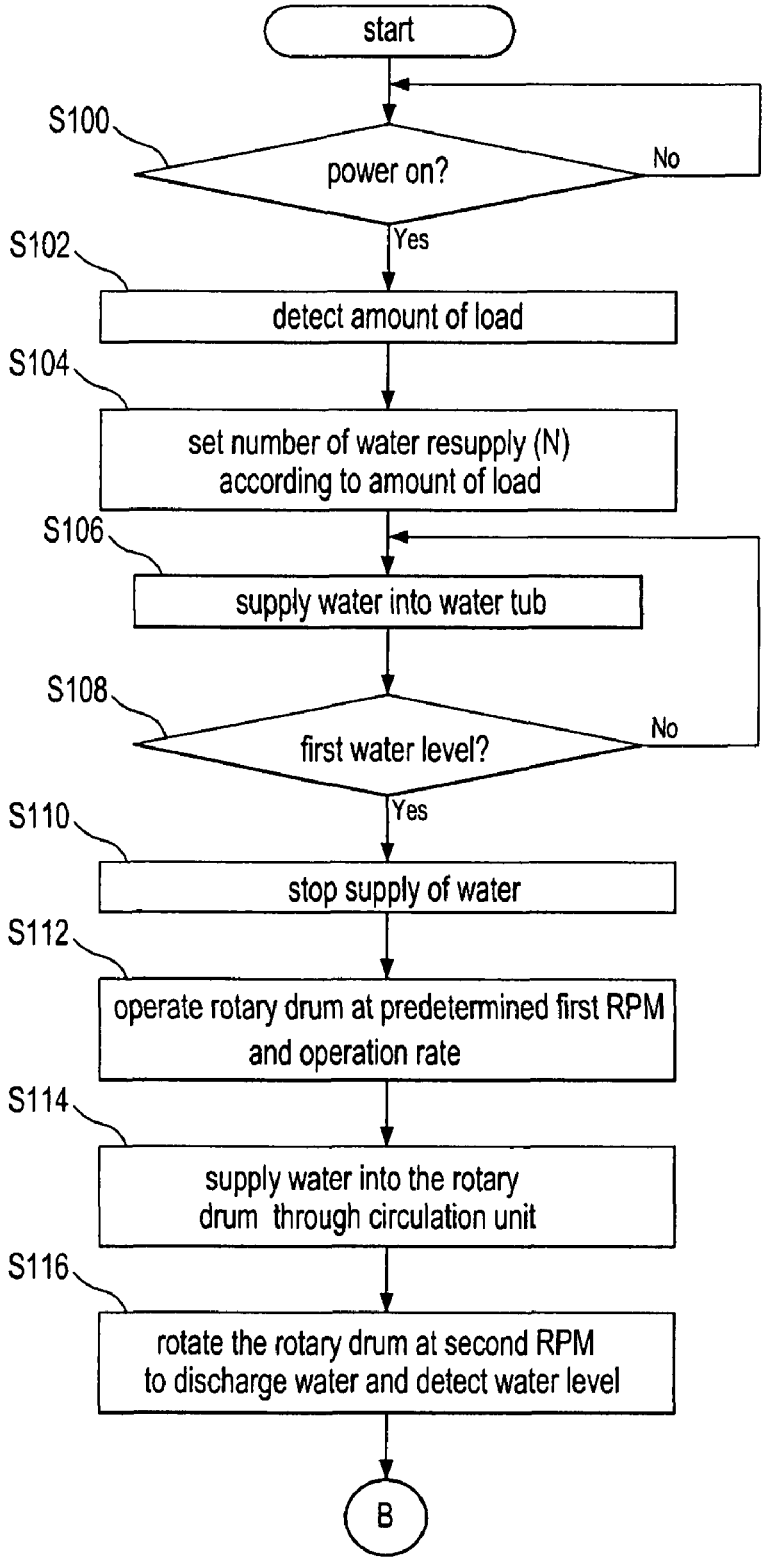
FIGS. 4A and 4B are flow charts illustrating a water level control method of the washing machine according to the present invention.
Figure 4B:
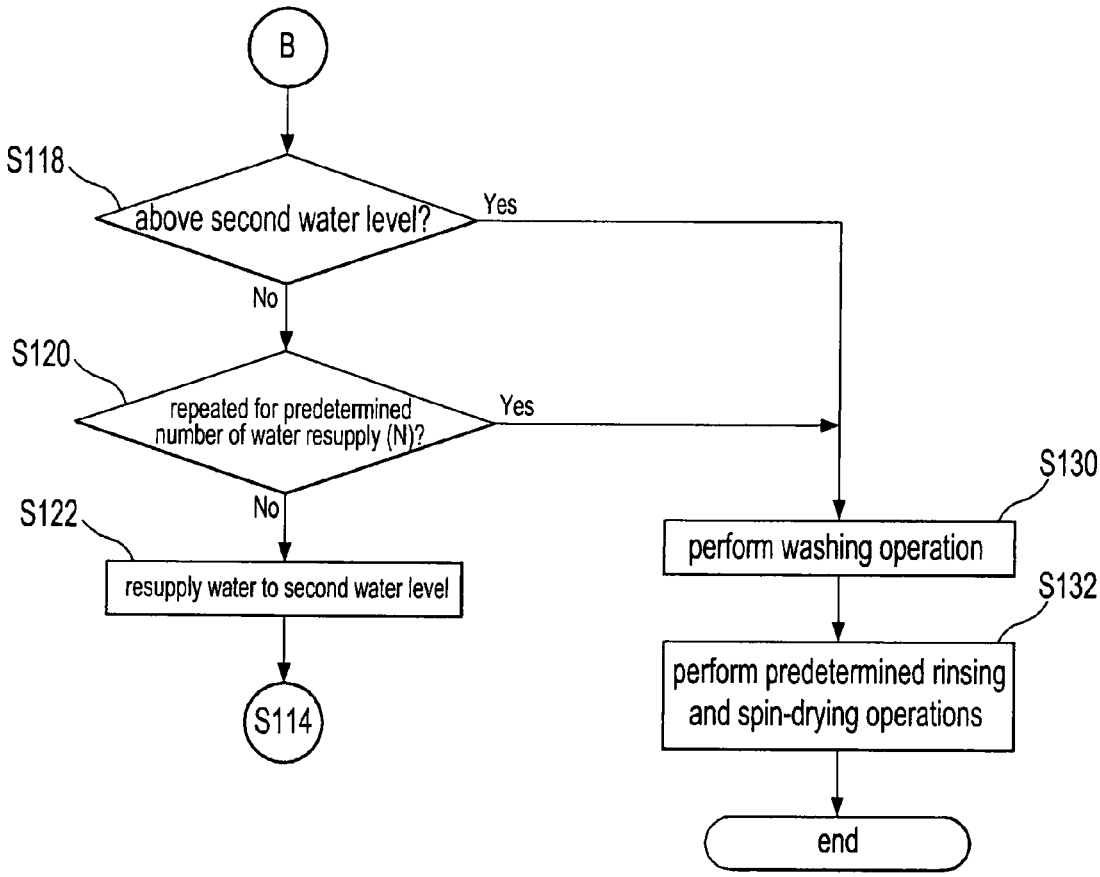

FIGS. 4A and 4B are flow charts illustrating a water level control method of the washing machine according to the present invention.

When a user puts laundry into the rotary drum 12 and selects operation information, such as a washing course, washing temperature, water-discharging RPM, and addition of rinsing, according to kinds of laundry, the operation information selected by the user is inputted to the control unit 56 through the signal input unit 54.

Consequently, the control unit 56 performs a washing operation according to the operation information inputted from the signal input unit 54. First, the control unit 56 determines whether power is on (S100).

When the power is on, the control unit 56 detects the amount of load (the amount or weight of the laundry) put into the rotary drum 12 (S102), and sets motor RPM, motor operation rate (motor on-off time) and the number of water resupplies N (the number of times to resupply water to the minimum water level necessary for heating washing when water is absorbed into the laundry, and therefore, the water level is lowered) according to the detected amount of the load (S104).

Here, the number of water resupplies N is set to restrict the resupply of water based on the amount of the laundry, thereby reducing unnecessary use of water.

Subsequently, the control unit 56 controls the water supply unit 20 to supply water to the laundry. As a result, the water supply valve 24 is opened, and wash water is supplied into the water tub 11 through the water supply pipes 21 and 22, the detergent supply unit 19, and the second water supply pipe 23 (S106).

When water for washing or rinsing is supplied, the water level of the water supplied into the water tub 11 is detected by the water level detection unit 52 to determine whether the detected water level is a predetermined first water level (the minimum amount of water supplied up to a height at which water supplied into the water tub can flow into the rotary drum, i.e., as shown in FIG. 1, the water level set to the lower boundary of the rotary drum and the diaphragm) (S108).

When the water level of water is the first water level, water is continuously supplied into the water tub 11 until the water level of water reaches the first water level, and, when the water level of water is not the first water level, the control unit 56 turns the water supply valve 24 off to stop the supply of water (S110).

After the supply of water is stopped, the control unit 56 drives the motor 15 to operate the rotary drum 12 at a predetermined first RPM (approximately 30 RPM) and a predetermined operation rate such that laundry can be wetted by the water supplied into the water tub 11 (S112).

As the rotary drum 12 is rotated, the water is introduced from the water tub 11 into the rotary drum 12. As a result, the water level of the wash water in the water tub 11 is lowered.

Subsequently, the control unit 56 drives the circulation unit 40 to supply an appropriate amount of water (wash water or rinse water) based on the amount of load (the amount of laundry). As a result, the flow changing valve 41 of the circulation unit 41 is operated such that the outlet side of the drainage pump 32 communicates with the circulation pipe 42. Then the drainage pump 32 is operated, and therefore, the water received in the lower part of the water tub 11 is supplied into the rotary drum 12 through the drainage pipe 31 and the circulation pipe 42 (S114). At this time, the water supplied into the rotary drum 12 is injected toward the laundry through the injection nozzle 43 such that the laundry can be wetted by the water. At this time, the rotary drum 12 is rotated at low speed by the motor 15.

In order to check how much water has been absorbed into the laundry, the control unit 56 detects the water level of the water gathered in the water tub 11 after the rotary drum 12 is operated at a predetermined second RPM (approximately 200 RPM) for a predetermined period of time (approximately 1 minute) to discharge the remaining water, which has not been absorbed into the laundry, out of the water tub 11 through the holes 12*d* formed in the front part 12*a* of the rotary drum 12 (S116).

During the water-discharging operation, the second RPM of the rotary drum 12 is decided based on the amount of load. The second RPM may be equal to or greater than the first RPM.

Also, the control unit 56 determines whether the water level of the water gathered in the water tub 11 is above a predetermined second water level (the minimum water level for heating washing at which the washing heater is submerged) (S118). When the water level of the water gathered in the water tub 11 is not above the second water level, the control unit 56 determines whether the water resupply operation to replenish the water tub 11 with water has been repeated for the predetermined number of water resupplies N (S120).

When it is determined at S120 that the water resupply operation to replenish the water tub 11 with water has not been repeated for the predetermined number of water resupplies N, the water supply valve 20 is operated to replenish the water tub 11 with water such that the water is resupplied into the water tub 11 until the water level in the water tub 11 reaches the second water level (S122). The procedure is returned to S114 so as to supply an appropriate amount of water (wash water or rinse water) based on the amount of the laundry, and the operation is carried out from S114 until the predetermined number of water resupplies N is repeated.

When it is determined at S118 that the water level of water gathered in the water tub 11 is above the second water level, which means that an appropriate amount of water has been supplied based on the amount of the laundry, the control unit 56 performs a washing operation set according to the amount of load while the water received in the lower part of the water tub 11 is supplied into the rotary drum 12 through the circulation unit 40 (S130). After that, the control unit 56 performs predetermined rinsing and spin-drying operations (S132).

As apparent from the above description, the washing machine with the holeless rotary drum according to the present invention can supply an appropriate amount of water based on the amount of laundry while using a water level sensor adopted in a conventional washing machine with a rotary drum having holes. Consequently, it is possible to control the water level with the optimum amount of water, and therefore, the unnecessary consumption of water is effectively prevented.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A water level control method of a washing machine including a water tub and a rotary drum mounted in the water tub to receive laundry, the rotary drum having no holes formed at the side corresponding to the water tub such that the flow of water from the water tub into the rotary drum is prevented, the water level control method comprising:

supplying water between the water tub and the rotary drum;

introducing the supplied water into the rotary drum, discharging the introduced water out of the rotary drum, and detecting the water level of the water remaining in the water tub;

comparing the detected water level with a predetermined water level and, when the detected water level is below the predetermined water level, resupplying water between the water tub and the rotary drum; and introducing the resupplied water into the rotary drum, discharging the introduced water out of the rotary drum, and controlling the water resupply operation until the water level of the water remaining in the water tub reaches the predetermined water level.

2. The water level control method according to claim 1, wherein the supplying water between the water tub and the rotary drum includes supplying a basic amount of water between the water tub and the rotary drum up to a height at which the water supplied into the water tub can flow into the rotary drum.

3. The water level control method according to claim 1, further comprising:

rotating the rotary drum to wet the laundry after supplying water between the water tub and the rotary drum.

4. The water level control method according to claim 3, wherein the wetting the laundry includes operating the rotary drum at a predetermined first RPM and operation rate based on an amount of the laundry.

5. The water level control method according to claim 1, wherein the detecting the water level of the water remaining in the water tub comprises:

operating a circulation unit to introduce the water from the water tub into the rotary drum; and rotating the rotary drum such that the water introduced into the rotary drum is discharged out of the rotary drum into the water tub and measuring the water level of water gathered in the water tub.

6. The water level control method according to claim 5, wherein, during the discharge of the water, the rotary drum is operated at a predetermined second RPM.

7. The water level control method according to claim 6, wherein the second RPM is equal to or greater than the first RPM.

8. The water level control method according to claim 1, further comprising:

setting a number of water resupplies according to the amount of the laundry, wherein resupplying water between the water tub and the rotary drum includes controlling a water resupply operation based on the set number of water resupplies.

9. The water level control method according to claim 8, further comprising:

after the water is resupplied between the water tub and the rotary drum, detecting the water level of the water changed as the resupplied water is introduced into the rotary drum and then is discharged out of the rotary drum, the detecting the water level of the water changed being repeatedly performed for the set number of water resupplies.

10. The water level control method according to claim 9, wherein, when the water level of the water changed is above the predetermined water level, a subsequent washing operation set based on the amount of the laundry is performed without repeating the set number of water resupplies.

11. A water level control method of a washing machine including a water tub and a rotary drum mounted in the water tub to receive laundry, the rotary drum having no holes formed at the side corresponding to the water tub such that the flow of water from the water tub into the rotary drum is prevented, the water level control method comprising:

supplying water between the water tub and the rotary drum;

introducing the supplied water into the rotary drum, discharging the introduced water out of the rotary drum, and detecting the water level of the water remaining in the water tub; and comparing the detected water level with a predetermined water level and, when the detected water level is above the predetermined water level, performing a subsequent washing operation set based on an amount of the laundry.

12. The water level control method according to claim 11, wherein the predetermined water level is the minimum amount of water supplied for heated washing.

* * * * *